US007706723B2

(12) United States Patent
Ishida et al.

(10) Patent No.: US 7,706,723 B2
(45) Date of Patent: Apr. 27, 2010

(54) IMAGE FORMING APPARATUS INCLUDING PHASE DIFFERENCE CORRECTION WITH A SINGLE DRIVE UNIT

(75) Inventors: Masahiro Ishida, Tokyo (JP); Kazuki Suzuki, Yokohama (JP); Tetsuji Nishikawa, Machida (JP); Yasuhiro Maehata, Sagamihara (JP); Takayuki Niihara, Atsugi (JP); Makoto Kikura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 11/871,410

(22) Filed: Oct. 12, 2007

(65) Prior Publication Data

US 2008/0089713 A1 Apr. 17, 2008

(30) Foreign Application Priority Data

Oct. 13, 2006 (JP) ..... 2006-279345
May 18, 2007 (JP) ..... 2007-132309

(51) Int. Cl.
*G03G 15/00* (2006.01)
*G03G 15/01* (2006.01)

(52) U.S. Cl. ..... 399/167; 399/301

(58) Field of Classification Search ..... 399/167, 399/88, 301, 394, 302
See application file for complete search history.

(56) References Cited

U.S. PATENT DOCUMENTS 5,875,380 A * 2/1999 Iwata et al. ..... 399/301
6,879,795 B2 * 4/2005 Ohashi et al. ..... 399/167
7,013,102 B2 * 3/2006 Ehara ..... 399/167
2006/0171748 A1 * 8/2006 Inui et al. ..... 399/301
2007/0031166 A1 * 2/2007 Zensai ..... 399/167
2007/0077090 A1 * 4/2007 Kim et al. ..... 399/167
2007/0253735 A1 * 11/2007 Sato ..... 399/167

FOREIGN PATENT DOCUMENTS

JP 10-207167 A * 8/1998
JP 2003-233235 8/2003
JP 2005-70596 3/2005
JP 2005-157169 6/2005
JP 2005-266109 9/2005
JP 2006-58415 3/2006
JP 2006-106506 4/2006
JP 2007-101890 4/2007

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus includes a plurality of image carriers, a drive mechanism, a plurality of drive force transmission gears, a phase difference detector, and a shift unit. The plurality of image carriers forms images of separate colors. The drive mechanism including a single drive unit for driving the plurality of image carriers simultaneously. The plurality of drive force transmission gears, provided for each of the image carriers, transmits a driving force from the drive unit to the image carriers. The phase difference detector detects a phase difference in drive speed among the image carriers. The shift unit, provided for each of the plurality of drive force transmission gears, meshes or unmeshes the drive force transmission gear to the drive mechanism. The shift unit is activated to correct any phase difference in drive speed of the image carriers based on a detection result detected with the phase difference detector.

18 Claims, 9 Drawing Sheets

IMAGE FORMING APPARATUS INCLUDING PHASE DIFFERENCE CORRECTION WITH A SINGLE DRIVE UNIT

CROSS-REFERENCE TO RELATED APPLICATIONS

This application claims priority from Japanese Patent Applications No. 2006-279345, filed on Oct. 13, 2006 and No. 2007-132309, filed on May 18, 2007 in the Japan Patent Office, the entire contents of which are hereby incorporated by reference herein.

BACKGROUND OF THE INVENTION

1. Field of the Invention

The present disclosure relates generally to an image forming apparatus using electrophotography, and more particularly, to a method of adjusting displacement of images formed on a transfer member such as an intermediate transfer member and recording media.

2. Description of the Background Art

Generally, an image forming apparatus having a tandem type arrangement is used as a color copier. Such an image forming apparatus is provided with an adjustment mechanism for adjusting a drive speed of image carriers for each color to form a color image without displacement of color images, such as black, cyan, magenta, and yellow. If the black, cyan, magenta, and yellow images are not correctly superimposed on each other, a resultant color image may not be of optimum image quality. Accordingly, displacement of color images must be suppressed.

Such color image displacement suppression may be accomplished, for example, by adjusting a drive speed of image carriers. Such image carrier drive speed adjustment may be conducted as follows: First, an image patch pattern, formed for each color used in the image forming apparatus, is formed on an intermediate transfer member (e.g., intermediate transfer belt) and scanned by an optical sensor. Any phase difference in drive speed among the image carriers (e.g., photoconductor drums) can then be detected based on a detection result of the optical sensor and the drive speed of drive units such as drive motors provided for each one of the image carriers are adjusted accordingly.

In another case, an image forming apparatus having tandem type arrangement may have a single drive unit to rotate a plurality of image carriers (e.g., photoconductor drums). In such image forming apparatus, a rotation phase of at least one of the plurality of image carriers is adjusted to reduce a load variation of a drive mechanism, which may occur over time.

Although such image forming apparatuses can correct phase differences in drive speeds among image carriers, such image forming apparatuses may not be able to achieve both reductions in cost and apparatus size as well as provide an effective correction mechanism for phase differences among the image carriers.

For example, if a drive unit (e.g., drive motor) is provided for each one of the image carriers as described above, phase differences in drive speeds among the image carriers can be corrected. However, the plurality of drive units might make it difficult to achieve reductions in cost and size of the image forming apparatus.

On the other hand, if only one drive unit (e.g., drive motor) is used for driving a plurality of image carriers, reductions in cost and apparatus size can be achieved with comparative ease. However, because of such configuration using only one drive unit, adjustment of the drive speed of each one of the image carriers may be difficult.

SUMMARY

The present disclosure relates to an image forming apparatus including a plurality of image carriers, a drive mechanism, a plurality of drive force transmission gears, a phase difference detector, and a shift unit. The plurality of image carriers form images of each color. The drive mechanism including a single drive unit drives the plurality of image carriers simultaneously. The plurality of drive force transmission gears, provided for each of the plurality of image carriers respectively, transmits a driving force from the single drive unit to the plurality of image carriers. The phase difference detector detects a phase difference in drive speed among the plurality of image carriers. The shift unit, provided for each of the plurality of drive force transmission gears respectively, mesh or unmesh the drive force transmission gear to the drive mechanism. The shift unit is activated when to correct the phase difference in drive speed among the plurality of image carriers based on a detection result detected with the phase difference detector.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
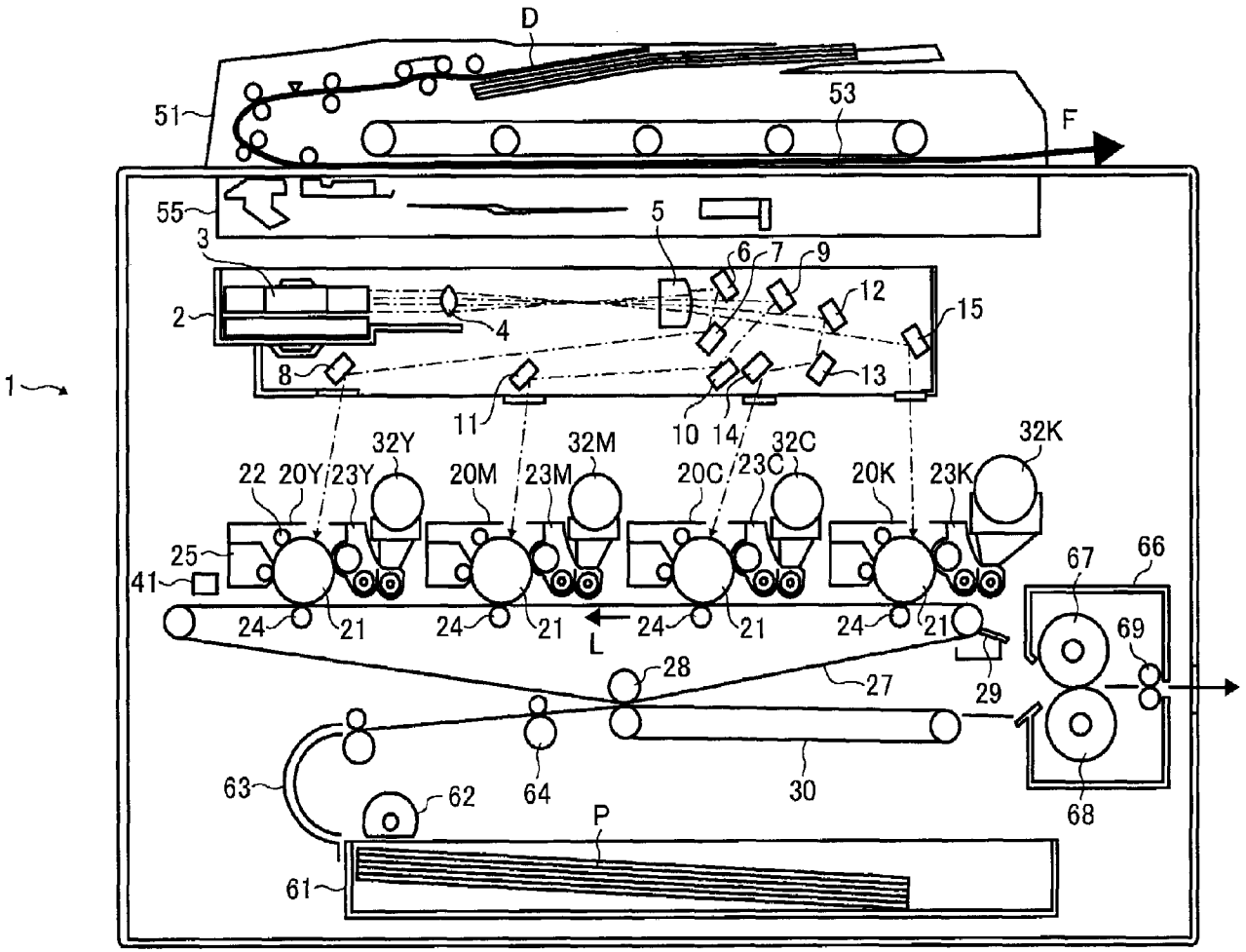
FIG. 1 illustrates a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing example embodiments shown in the drawings, specific terminology is employed for the sake of clarity, the present disclosure is not limited to the specific terminology so selected and it is to be understood that each specific element includes all technical equivalents that operate in a similar manner.

In this disclosure, a "process cartridge" may mean one unit which integrates an image carrier and at least one of a charger for charging the image carrier, a developing unit for developing a latent image formed on the image carrier, and a cleaning unit for cleaning the image carrier, and such "process cartridge" is detachably provided in an image forming apparatus.

Referring now to the drawings, wherein like reference numerals designate identical or corresponding parts throughout the several views, an image forming apparatus according to an example embodiment is described with particular reference to FIG. 1. In this disclosure, a "developing agent" means any one of "carrier," "toner," and "two-component developing agent having carrier and toner" used for developing process, and each term is used in the following description, as required.

As illustrated in FIG. 1, an image forming apparatus 1 includes an optical writing unit 2, process cartridges 20Y, 20M, 20C, 20K, a photoconductive drum 21, a charger 22, developing units 23Y, 23M, 23C, 23K, a primary transfer roller 24, a cleaning unit 25, an intermediate transfer belt 27, a secondary transfer roller 28, a belt cleaning unit 29, a transport belt 30, toner supply units 32Y, 32M, 32C, 32K, a document feeder 51, a scanner 55, a sheet feed unit 61, and a fixing unit 66. In this disclosure, Y, M, C, and K represent color of yellow, magenta, cyan, and, black, respectively.

The optical writing unit 2 emits a laser beam based on input image information.

Each of the process cartridges 20Y, 20M, 20C, and 20K corresponds to a process cartridge for producing yellow, magenta, cyan, and black image, respectively. The respective photoconductive drum 21 functions as image carrying member for process cartridges 20Y, 20M, 20C, and 20K. The charger 22 charges a surface of the photoconductive drum 21 uniformly.

Each of the developing units 23Y, 23M, 23C, and 23K develops an electrostatic latent image formed on the respective photoconductive drum 21 as toner image.

The primary transfer roller 24 transfers the toner image from the photoconductive drum 21 to the intermediate transfer belt 27.

The cleaning unit 25 recovers toners remained on the photoconductive drum 21 after the toner image is transferred from the photoconductive drum 21 to the intermediate transfer belt 27.

The intermediate transfer belt 27 receives a plurality of toner images from the process cartridges 20Y, 20M, 20C, and 20K.

The secondary transfer roller 28 transfers the toner images from the intermediate transfer belt 27 to a recording medium P.

The belt cleaning unit 29 recovers toners remained on the intermediate transfer belt 27 after the toner images are transferred from the intermediate transfer belt 27 to the recording medium P.

The transport belt 30 transports the recording medium P having the toner images thereon.

Each of the toner supply units 32Y, 32M, 32C, and 32K supplies respective color toner to each of the developing units 23Y, 23M, 23C, and 23K, respectively, as required.

The document feeder 51 feeds a document D to the scanner 55, which scans image information of the document D.

The sheet feed unit 61 stores the recording medium P such as transfer sheet. The fixing unit 66 fixes toner images on the recording medium P.

Each of the process cartridges 20Y, 20M, 20C, and 20K can integrate the photoconductive drum 21, the charger 22, and the cleaning unit 25 as one unit. In each of the process cartridges 20Y, 20M, 20C, and 20K, an image forming of yellow, magenta, cyan, and black image is respectively conducted on the respective photoconductive drum 21.

A description is now given to an image forming operation in the image forming apparatus 1 with reference to FIG. 1.

First, the document D placed on a document tray of the document feeder 51 is transported in a direction shown by an arrow F in FIG. 1 with transport rollers, and placed on a contact glass 53 of the scanner 55 to optically scan image information of the document D by the scanner 55.

Specifically, the scanner 55 scans a light beam, generated with a light source (not illustrated), to an image on the document D placed on the contact glass 53.

A light reflected from the document D is focused onto a color sensor (not illustrated) via mirrors and lenses. The color sensor reads color image information of the document D as RGB (i.e., red, green, and blue) information, and then converts RGB information to electric signals.

Based on the electric signals for RGB information, an image processor (not illustrated) conducts various processes such as color converting process, color correction process, and spatial frequency correction process to obtain color image information of yellow, magenta, cyan, and, black.

The color image information of yellow, magenta, cyan, and black are then transmitted to the optical writing unit 2. The optical writing unit 2 emits a laser beam corresponding to the color image information of yellow, magenta, cyan, and black, to the respective photoconductive drum 21 in the process cartridges 20Y, 20M, 20C, and 20K.

The photoconductive drum 21 is rotated in a clockwise direction in FIG. 1 by a drive mechanism, which will be described later with reference to FIGS. 3 and 4.

The charger 22 uniformly charges a surface of the photoconductive drum 21 to form a charge potential on the photoconductive drum 21.

When the charged surface of photoconductive drum 21 comes to an irradiation position, the optical writing unit 2 emits a laser beam corresponding to each color of yellow, magenta, cyan, and black.

As illustrated in FIG. 1, the laser beam reflected at a polygon mirror 3 passes lenses 4 and 5, and then follows a separate light path for each color of yellow, magenta, cyan, and black.

A laser beam for yellow component, reflected on mirrors 6 to 8, irradiates a surface of the photoconductive drum 21 in the process cartridge 20Y as illustrated in FIG. 1. Such laser beam for yellow component is scanned in a main scanning direction of the photoconductive drum 21 with a rotation of the polygon mirror 3, rotating at a high speed. With such laser beam scanning, an electrostatic latent image for yellow component is formed on the photoconductive drum 21.

In a similar way, a laser beam for magenta component, reflected on mirrors 9 to 11, irradiates a surface of the photoconductive drum 21 in the process cartridge 20M as illustrated in FIG. 1, and an electrostatic latent image for magenta component is formed on the photoconductive drum 21.

In a similar way, a laser beam for cyan component, reflected on mirrors 12 to 14, irradiates a surface of the photoconductive drum 21 in the process cartridge 20C as illustrated in FIG. 1, and an electrostatic latent image for cyan component is formed on the photoconductive drum 21.

In a similar way, a laser beam for black component reflected on a mirror 15 irradiates a surface of the photoconductive drum 21 in the process cartridge 20K as illustrated in FIG. 1, and an electrostatic latent image for black is formed on the photoconductive drum 21.

Then, each of the electrostatic latent images on the respective photoconductive drum 21 comes to a position facing each of the developing units 23Y, 23M, 23C, and 23K. Each of the developing units 23Y, 23M, 23C, and 23K supplies respective color toner (i.e., yellow, magenta, cyan, and black) to the respective photoconductive drum 21 to develop respective toner image on the respective photoconductive drum 21.

After such developing process, the photoconductive drum 21 comes to a position facing the intermediate transfer belt 27. As illustrated in FIG. 1, four primary transfer rollers 24, provided at inner face of the intermediate transfer belt 27, face the respective photoconductive drum 21 via the intermediate transfer belt 27. Such four primary transfer rollers 24 are used to transfer toner images on the respective photoconductive drum 21 to the intermediate transfer belt 27 by superimposing toner images on the intermediate transfer belt 27.

Then, the photoconductive drum 21 comes to a position facing the cleaning unit 25. The cleaning unit 25 recovers toners remained on the photoconductive drum 21 after developing process. Then, a de-charger (not illustrated) de-charges the photoconductive drum 21 to prepare the photoconductive drum 21 for a next image forming operation on the photoconductive drum 21.

The intermediate transfer belt 27 having toner images thereon travels in a direction shown by an arrow L in FIG. 1, and comes to a position of secondary transfer roller 28. At the secondary transfer roller 28, the toner images are transferred from the intermediate transfer belt 27 to the recording medium P.

Further, an image patch pattern, to be described later, is formed on the intermediate transfer belt 27 in a similar image forming process, wherein the image patch pattern is used for adjusting image forming condition or for correcting a displacement of color images.

Then, the intermediate transfer belt 27 comes to a position facing the belt cleaning unit 29, which is used to recover toners remained on the intermediate transfer belt 27, by which a transfer process for intermediate transfer belt 27 completes.

During such image forming process, the recording medium P is transported to the position of the secondary transfer roller 28 from the sheet feed unit 61 via a transport guide 63 and registration roller 64.

Specifically, the recording medium P such as transfer sheet in the sheet feed unit 61 is fed to the transport guide 63 by a feed roller 62, and further fed to the registration roller 64.

Such registration roller 64 feeds the recording medium P to the position of the secondary transfer roller 28 by synchronizing a feed timing with toner-image formation timing on the intermediate transfer belt 27.

Then, the recording medium P having the toner images thereon is transported to the fixing unit 66 by the transport belt 30.

The fixing unit 66 includes a heat roller 67 and a pressure roller 68 as illustrated in FIG. 1. The fixing unit 66 fixes the toner images on the recording medium P at a fixing nip between the heat roller 67 and pressure roller 68.

After fixing the toner images on the recording medium P, the recording medium P is ejected from the image forming apparatus 1 by an ejection roller 69, by which an image forming process for one cycle is completed.

In such image forming apparatus 1, a black and white image can be formed by only forming a toner image on the photoconductive drum 21 of the process cartridge 20K, one color image of yellow, magenta, or cyan can be formed by forming a toner image on the photoconductive drum 21 of the process cartridge 20Y, 20M, or 20C, or a three-color image of yellow, magenta, and cyan can be formed by forming a toner image on the photoconductive drum 21 of the process cartridges 20Y, 20M, and 20C.

Figure 2:
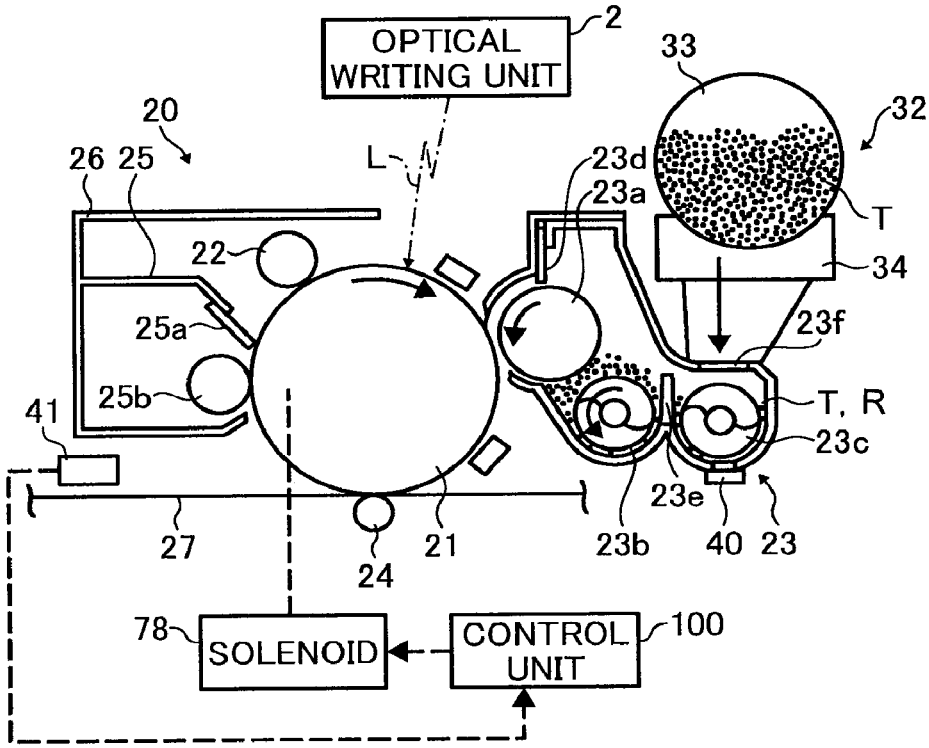
FIG. 2 illustrates a schematic view of an image forming unit of the image forming apparatus of FIG. 1.

A description is now given of an image forming section of the image forming apparatus 1 with reference to FIG. 2, which is a schematic view of an image forming section in the image forming apparatus 1.

The image forming apparatus 1 includes four image forming sections for image forming process. Because the four image forming sections have a similar configuration one to another except a color of toner T, reference characters of Y, M, C, and K for process cartridges, developing units, and toner supply units or other parts are omitted from FIG. 2.

As illustrated in FIG. 2, the process cartridge 20 includes the photoconductive drum 21 as image carrying member, the charger 22, and the cleaning unit 25, which may be encased in a case 26, for example. The cleaning unit 25 includes a cleaning blade 25*a* and a cleaning roller 25*b*, which are contactable to the photoconductive drum 21 as illustrated in FIG. 2.

The developing unit 23 includes a developing roller 23*a*, a first transport screw 23*b*, a second transport screw 23*c*, and a doctor blade 23*d*, and a magnetic permeability sensor 40 as illustrated in FIG. 2.

As illustrated in FIG. 2, the developing roller 23*a* faces the photoconductive drum 21, and the doctor blade 23*d* faces the developing roller 23*a*.

The first transport screw 23*b* faces the developing roller 23*a*, and also faces the second transport screw 23*c* via a separator 23*e* provided between the first transport screw 23*b* and the second transport screw 23*c* as illustrated in FIG. 2.

The developing roller 23*a* includes a magnet, and a sleeve. The magnet is provided inside the sleeve, and generates magnetic poles over the developing roller 23*a*. The sleeve, made of non-magnetic material, can rotate around the magnet.

As illustrated in FIG. 2, the developing unit 23 contains a two-component developing agent having toner T and carrier R (i.e., magnetic component), and the magnetic permeability sensor 40 is used to detect toner concentration in the developing agent.

A description is now given to a developing process in the image forming process with reference to FIG. 2.

The developing roller 23*a* rotates in a direction shown by an arrow in FIG. 2. As illustrated in FIG. 2, the first transport screw 23*b* and the second transport screw 23*c* rotate in a respective direction shown by an arrow in FIG. 2. Accordingly, when the toner T (i.e., fresh toner) is supplied to the developing unit 23 from the toner supply unit 32 through a toner supply port 23*f*, the developing agent in the developing unit 23 is agitatingly mixed with the toner T (i.e., fresh toner).

The first transport screw 23*b* transports the developing agent in one direction, and the second transport screw 23*c* transports the developing agent in another direction. In other words, the first transport screw 23*b* and second transport screw 23*c* transport the developing agent in opposite directions.

The toner T may adhere on the carrier R with a frictional effect when the toner T and carrier R are agitatingly mixed in the developing unit 23. Such toner T and carrier R (i.e., developing agent) are carried up to the developing roller 23*a* as developing agent.

The developing agent carried up onto the developing roller 23*a* comes to a position facing the doctor blade 23*d* with a rotation of the developing roller 23*a*, wherein the doctor blade 23*d* is used to regulate an amount of developing agent on the developing roller 23*a*. Then, the developing agent on the developing roller 23*a*, regulated to preferable amount by the doctor blade 23*d*, comes to a position facing the photoconductive drum 21.

At such position, the toner T in developing agent adheres on the electrostatic latent image formed on the photoconductive drum 21.

Specifically, an electric field is formed between the photoconductive drum 21 and the developing roller 23*a* because an electric potential of electrostatic latent image, formed by irradiating the laser beam L on the photoconductive drum 21, and a developing bias potential applied to the developing roller 23*a* have a potential difference. The toner T can be adhered to the electrostatic latent image with an effect of such potential difference between the photoconductive drum 21 and the developing roller 23*a*.

The toner T adhered on the photoconductive drum 21 during the above-mentioned developing process is then transferred onto the intermediate transfer belt 27. After such transferring of toner image, the cleaning blade 25*a* and the cleaning roller 25*b* recovers toners remained on the photoconductive drum 21 in the cleaning unit 25.

As illustrated in FIG. 2, the toner supply unit 32 includes a toner cartridge 33 and a hopper unit 34, for example. The toner cartridge 33 stores the fresh toner (e.g., yellow, magenta, cyan, and black toner), and is removable from the image forming apparatus 1. The hopper unit 34 holds and rotates the toner cartridge 33 in one direction to supply fresh toner to the developing unit 23. Such toner cartridge 33 containing fresh toner (e.g., yellow, magenta, cyan, black) has helically-protruded portion on an inner face of the toner cartridge 33.

The toner T in the toner cartridge 33 can be supplied to the developing unit 23, as required, through the toner supply port 23*f* when toners in the developing unit 23 are consumed by image forming operations.

As illustrated in FIG. 2, the developing unit 23 includes the magnetic sensor 40 (i.e., toner concentration sensor) under the second transport screw 23*c* to detect a consumption rate of toners in the developing unit 23.

When the magnetic sensor 40 detects that a toner concentration in the developing unit 23 becomes lower than a given toner concentration, defined by a ratio of toner T in developing agent, the toner T is supplied from the toner supply unit 32 to the developing unit 23 through the toner supply port 23*f* until the magnetic sensor 40 detects that a toner concentration in the developing unit 23 becomes the given toner concentration.

The developing unit 23 also includes a photosensor 41 at a given position, which faces the intermediate transfer belt 27 to detect a consumption rate of toners in the developing unit 23.

Such photosensor 41 includes a light-emitting element (e.g., light emitting diode) and a light-receiving element (e.g., photodiode). Such photosensor 41 is used to detect an amount of toner adhered as image patch pattern (or toner image) formed on the intermediate transfer belt 27, and detect an amount of toner adhered on a non-image area of the intermediate transfer belt 27 at a given timing.

The photosensor 41 transmits a signal of detection result (e.g., voltage corresponding the received light) to a control unit 100. The control unit 100 processes such signal to determine a preferable level of a position alignment of each toner image, and an image forming condition for the photoconductive drum 21 (e.g., image forming timing, developing bias potential, charging potential, exposing potential).

In this example embodiment, a solenoid 78 is activated to correct a phase difference of drive speed of four photoconductive drums 21 based on such detection result detected by the photosensor 41.

A description is now given to a drive system 70 for adjusting or correcting a phase difference in drive speeds among four photoconductive drums 21 (21Y, 21M, 21C, 21K) using the solenoid 78 with reference to FIGS. 3 to 6.

Figure 3:
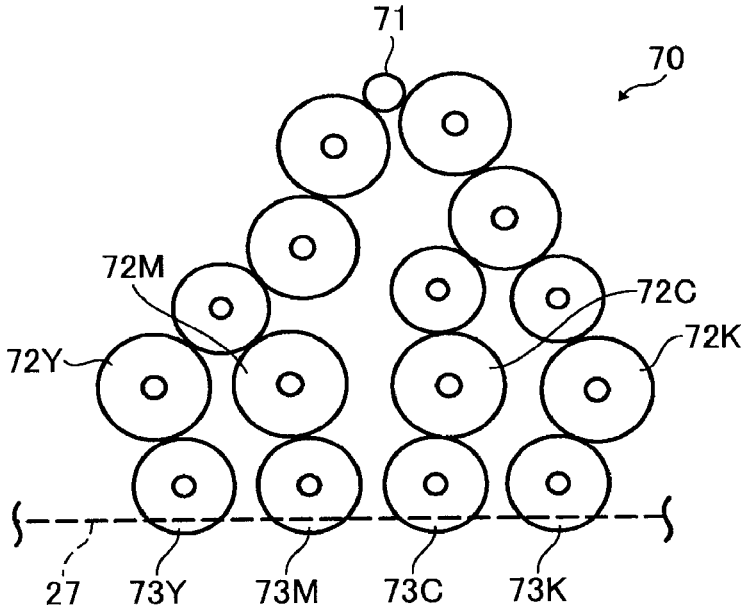
FIG. 3 illustrates a schematic view of a drive mechanism provided in the image forming apparatus of FIG. 1.
Figure 4:
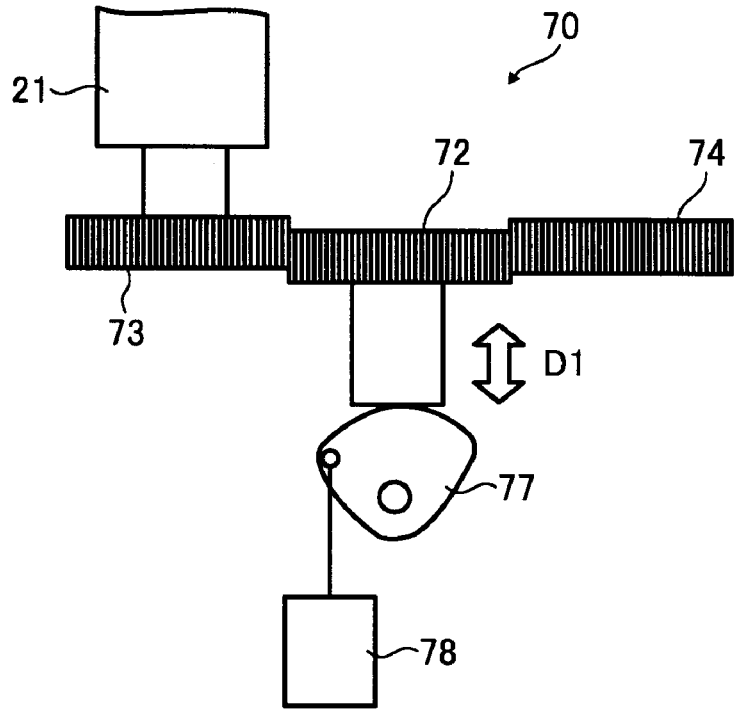
FIG. 4 illustrates a schematic view of a shift unit provided in the drive mechanism of FIG. 3.

FIG. 3 illustrates the drive system 70 for driving four photoconductive drums 21 (21Y, 21M, 21C, 21K), and FIG. 4 illustrates a schematic view of a shift unit for moving an idler gear 72, provided in the drive system 70, in a thrust direction.

As illustrated in FIG. 3, the drive system 70 has a single drive unit (i.e., drive motor 71) to rotate four photoconductive drums 21 used as image carriers.

Specifically, a driving force of the drive motor 71 is transmitted to each one of driven gears 73Y, 73M, 73C, and 73K via a motor gear attached to a shaft of the drive motor 71 and a plurality of gears meshed to the motor gear.

For example, each one of the driven gears 73Y, 73M, 73C, and 73K may be respectively attached to a shaft of each one of the photoconductive drums 21Y, 21M, 21C, and 21K, and may rotate with each one of the photoconductive drums 21Y, 21M, 21C, and 21K. Accordingly, the four photoconductive drums 21Y, 21M, 21C, and 21K can be simultaneously rotated by a single drive unit (i.e., drive motor 71).

In an example embodiment, a single drive unit (e.g., drive motor 71) is used to drive (or rotate) the four photoconductive drums 21 instead of providing a drive motor for each one of photoconductive drums, by which reductions in cost and apparatus can be achieved.

In the drive system 70 illustrated in FIG. 3, four idler gears 72Y, 72M, 72C, and 72K are meshed to the four driven gears 73Y, 73M, 73C, and 73K, respectively, wherein the idler gears 72Y, 72M, 72C, and 72K are used as drive force transmission gear to transmit a driving force from the drive motor 71 to the photoconductive drums 21Y, 21M, 21C, and 21K, respectively.

Such idler gears 72Y, 72M, 72C, and 72K can be moved in a thrust direction by a shift unit shown in FIG. 4. As illustrated in FIG. 4, the shift unit includes a solenoid 78 and a cam 77, for example.

Although the idler gear 72 is meshed to the driven gear 73 directly in FIG. 3, another configuration that the idler gear 72 is not meshed to the driven gear 73 directly can be employed for the drive system 70.

Specifically, as illustrated in FIG. 4, the idler gear 72 (used as drive force transmission gear) transmits a driving force to the driven gear 73, coupled to the photoconductive drum 21, from a gear 74, disposed in an upstream side of the drive system 70.

As illustrated in FIG. 4, the idler gear 72 has an end face, which contacts the cam 77 coupled to the solenoid 78, and although not illustrated, the idler gear 72 is biased toward the cam 77 with a biasing member. Accordingly, when the solenoid 78 is set to a power-on or power-off condition, the idler gear 72 can be moved in a direction shown by an arrow D1, wherein such direction may be termed as thrust direction or rotation shaft direction.

For example, when the solenoid 78 is set to a power-off condition, the idler gear 72 meshes with the gear 74 and the driven gear 73, by which the drive motor 71 can rotate the photoconductive drum 21, and when the solenoid 78 is set to a power-on condition, the idler gear 72 is unmeshed from the gear 74 and the driven gear 73, by which the drive motor 71 cannot rotate the photoconductive drum 21.

Such shift unit having the cam 77 and the solenoid 78 is provided for each one of the photoconductive drums 21Y, 21M, 21C, and 21K (or the idler gears 72Y, 72M, 72C, and 72K), by which each of the idler gears 72Y, 72M, 72C, and 72K can be independently set to a meshed or unmeshed condition.

The above-mentioned photosensor 41 is used as phase difference detector to detect a phase difference in drive speeds among four photoconductive drums 21. Based on a detection result of the photosensor 41, the shift unit having the cam 77 and the solenoid 78 is controlled to correct a phase difference in drive speeds among the photoconductive drums 21.

Specifically, the photosensor 41 detects an image patch pattern for each color transferred onto the intermediate transfer belt 27 from each of photoconductive drums 21.

Preferably, each of image patch patterns is formed on the intermediate transfer belt 27 with an interval of a circumference length of a drive roller, which is used to drive the intermediate transfer belt 27, wherein such drive roller is one of rollers extending the intermediate transfer belt 27.

In general, a drive roller may not be shaped in a perfect circle (or the drive roller may have some out-of-roundness) due to constrain on manufacturing process. Similarly, a drive gear attached to the drive roller may have some out-of-roundness. Accordingly, when the drive roller rotate one time, a rotational variation may occur, by which a rotational variation may also occur to the intermediate transfer belt 27.

If image patch patterns may be formed at any positions on the intermediate transfer belt 27, such image patch patterns may include a component of rotational variation of the drive roller, which is not desirable for detecting a phase difference in drive speeds among photoconductor drums 21 with a higher precision.

On one hand, in an example embodiment, by forming each of image patch patterns with an interval of the circumference length of the drive roller, image patch patterns can be formed on the intermediate transfer belt 27 without such rotational variation of the drive roller. Accordingly, a detection of phase difference in drive speeds among photoconductor drums 21 can be conducted with a higher precision.

The control unit 100 has a computing unit to compute a phase difference in drive speeds among the photoconductive drums 21 based on a detection time of image patch patterns of each color, which is detected with the photosensor 41.

Based on phase difference in drive speeds among the photoconductive drum 21 detected with the photosensor 41, the shift unit having the cam 77 and the solenoid 78 is controlled to correct any phase difference in drive speeds among the photoconductive drums 21.

For example, if phase difference in drive speeds is only occurring on the photoconductive drum 21Y for yellow, the shift unit is activated to unmesh the idler gear 72Y for yellow from the drive system 70 for a given time period to correct a phase difference in drive speeds among the photoconductive drum 21Y.

With such correction of phase difference in drive speeds among the photoconductive drums 21, a plurality of toner images can be superimposingly transferred on the intermediate transfer belt 27 by suppressing a displacement of color images.

The drive motor 71 used as drive unit is preferably a stepping motor or a DC (direct current) motor having a brake function. Such drive motor may have a higher responsiveness when to stop a driving of the photoconductive drums 21, by which a correction of phase difference in drive speeds with the shift unit having the cam 77 and the solenoid 78 can be conducted with a higher precision.

Further, in an example embodiment, the idler gear 72 is provided to a position closer to the drive motor 71 and farther from the photoconductive drum 21. In other words, the idler gear 72 is provided to a position closer to the drive motor 71, wherein such position has a smaller speed reduction rate.

If the idler gear 72 is set at a position closer to the photoconductive drum 21 and the idler gear 72 is set to a meshed condition from a unmeshed condition at such position, the photoconductive drum 21 may be displaced undesirably even if one tooth of the idler gear 72 is deviated from a given meshing position when meshing the idler gear 72.

On one hand, if the idler gear 72 is set at a position closer to the drive motor 71, which has a smaller speed reduction rate, a positional deviation of one tooth of the idler gear 72 from a given position may not cause a significant effect on the photoconductive drum 21.

As such, if the idler gear 72 is set at a position closer to the drive motor 71, a displacement of tooth meshing position of the idler gear 72, which may occur when to set the idler 72 to a meshed condition from an unmeshed condition, may not cause a significant effect on the photoconductive drum 21. Accordingly, a correction of phase difference in drive speeds among the photoconductive drums 21 can be conducted with a higher precision.

Although the idler gear 72 may be moved in a thrust direction (or rotation shaft direction) by the shift unit as illustrated in FIG. 4, the idler gear 72 can be moved in another direction, which may be perpendicular to a thrust direction.

Figure 5:
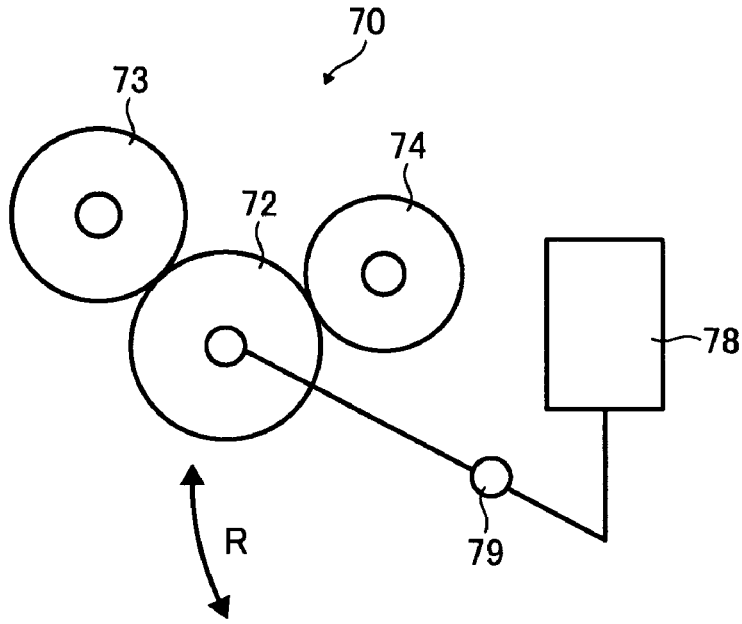
FIG. 5 illustrates a schematic view of another shift unit provided in the drive mechanism of FIG. 3.

For example, as illustrated in FIG. 5, the idler gear 72 can be coupled to the solenoid 78 via a rotation center 79 and a coupling shaft, which can rotate at the rotation center 79. By changing a power-on/power-off condition of the solenoid 78, the idler gear 72 can be moved in a direction shown by an arrow R in FIG. 5 to mesh or unmesh the idler gear 72 with the driven gear 73 and the gear 74. Such configuration illustrated in FIG. 5 may have a similar effect of a configuration illustrated in FIG. 4.

In an example embodiment, the shift unit (having the cam 77 and the solenoid 78) is controlled to correct a phase difference in drive speeds when at least one of four photoconductive drums 21 is detached or replaced with respect to the image forming apparatus 1. In an example embodiment, the detachment/replacement of the photoconductive drum 21 may be determined by detecting an opening/closing of a door cover of the image forming apparatus 1, wherein the door cover is opened and closed when conducting a detachment/replacement operation of the process cartridge 20.

Figure 6:
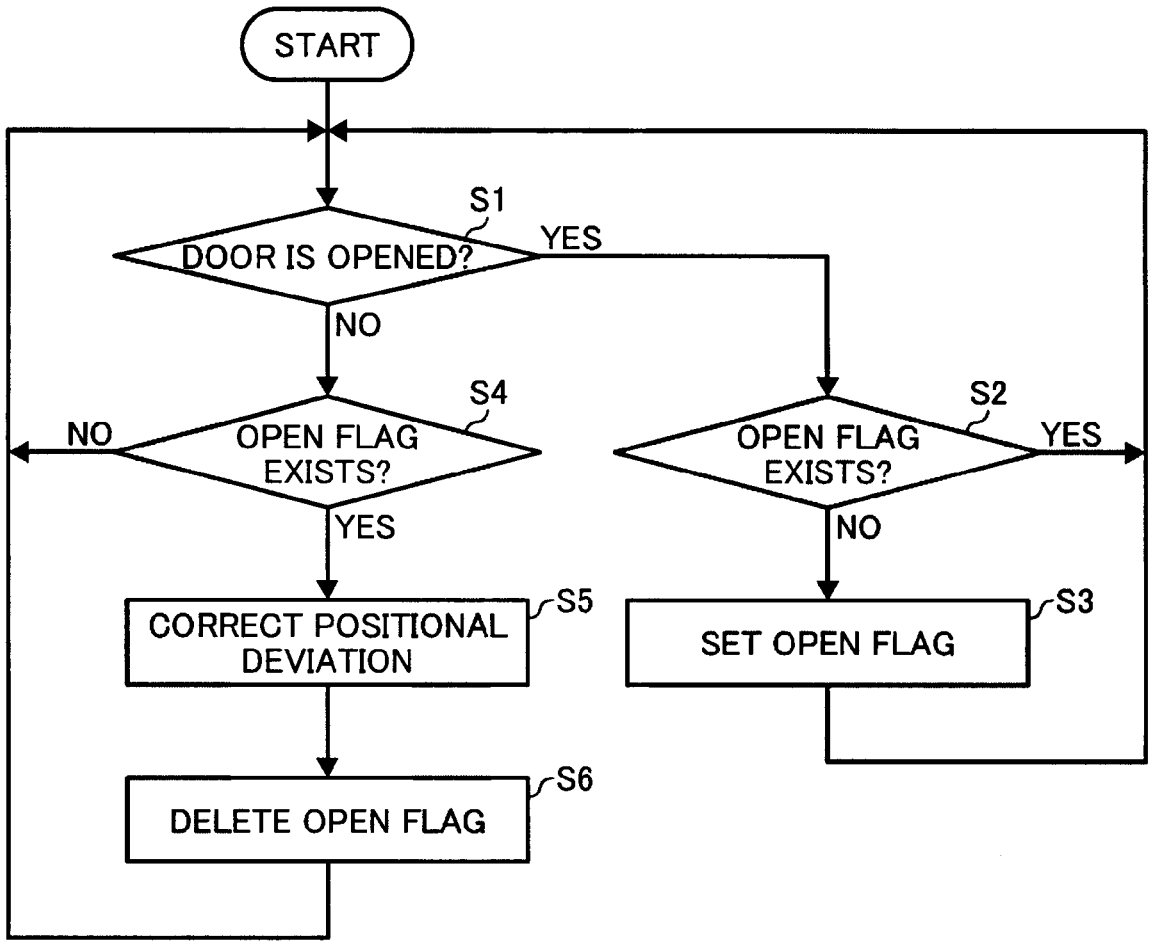
FIG. 6 is a flowchart for illustrating a control process for a positional deviation correction to be conducted in the image forming apparatus of FIG. 1.

FIG. 6 is a flowchart for illustrating a control process for a positional deviation correction, in which a phase difference in drive speeds among photoconductor drums is corrected.

First, in step S1, it is determined whether a door cover of the image forming apparatus 1 is opened with a signal of a cover sensor (not illustrated) for the door cover.

If it is determined that the door cover is opened (Yes in step S1), it is determined whether an open flag exists in step S2.

If it is determined that the open flag exists (Yes in step S2), it is determined that the door cover is not closed yet, and the process goes back to step S1.

If it is determined that the open flag does not exist (No in step S2), the open flag is set in step S3, and the process goes back to step S1.

If it is determined that the door cover is not opened (or it is determined that the door cover is closed) (No in step S1), it is determined whether an open flag exists in step S4.

If it is determined that the open flag does not exist (No in step S4), it is determined that the photoconductive drum 21 (or process cartridge 20) is not detached/replaced from the image forming apparatus 1, and the process goes back to step S1.

If it is determined that the open flag exists (Yes in step S4), it is determined that the photoconductive drum 21 (or the process cartridge 20) is detached/replaced from the image forming apparatus 1, and a positional deviation correction is conducted in step S5.

Specifically, based on a detection result detected with the photosensor 41 used as phase difference detector, the shift unit (having the solenoid 78) is activated to correct a phase difference in drive speeds among the photoconductive drums 21.

After correcting phase difference in drive speeds among the photoconductive drums 21, the open flag is deleted in step S6, and the process completes.

As above described, whenever the photoconductive drum 21 (or process cartridge 20) is detached or replaced from the image forming apparatus 1, a positional deviation correction is conducted for the photoconductive drums 21, by which a plurality of toner images may be superimposingly transferred onto the intermediate transfer belt 27 while suppressing a displacement of color images.

Although not illustrated, a rotation position detector for detecting a rotational position of the photoconductive drum 21 is disposed in the image forming apparatus 1.

For example, a detection plate having a detection mark may be attached to a shaft of the photoconductive drum 21, and a photosensor (or rotation position detector) optically detects the detection mark on the detection plate. A detection result detected with the photosensor (or rotation position detector) can be feed backed for the positional deviation correction. Accordingly, the positional deviation correction of the photoconductive drums 21 can be conducted more precisely.

Further, if such photosensor (or rotation position detector) is disposed to the image forming apparatus 1 but not on the process cartridge 20, a cost associated to the process cartridge 20, which may be replaced with a higher frequency, can be reduced.

As above described, in an example embodiment, a single drive unit (i.e., drive motor 71) transmits a driving force to a plurality of photoconductive drums 21 (used as image carriers) via the idler gear 72 (used as drive force transmission gear) provided for each one of the photoconductive drums 21, and a phase difference in drive speeds among the plurality of photoconductive drums 21 is controlled by moving the idler gear 72 with the shift unit.

Such configuration can achieve reductions in cost and apparatus size of an image forming apparatus while correcting a phase difference in drive speeds among a plurality of photoconductive drums 21 to suppress a displacement of color images of toner images having different color images.

Although the image forming apparatus 1 having tandem type arrangement uses the intermediate transfer belt 27 as intermediate transfer member, the image forming apparatus 1 can also use an intermediate transfer member having a drum shape with a similar manner in an example embodiment.

Although the photoconductive drum 21 is encased in the process cartridge 20, and the process cartridge 20 is detachable from the image forming apparatus 1 in an example embodiment, the photoconductive drum 21 alone can be directly attached to the image forming apparatus 1 without encasing the photoconductive drum 21 in the process cartridge 20.

Figure 7:
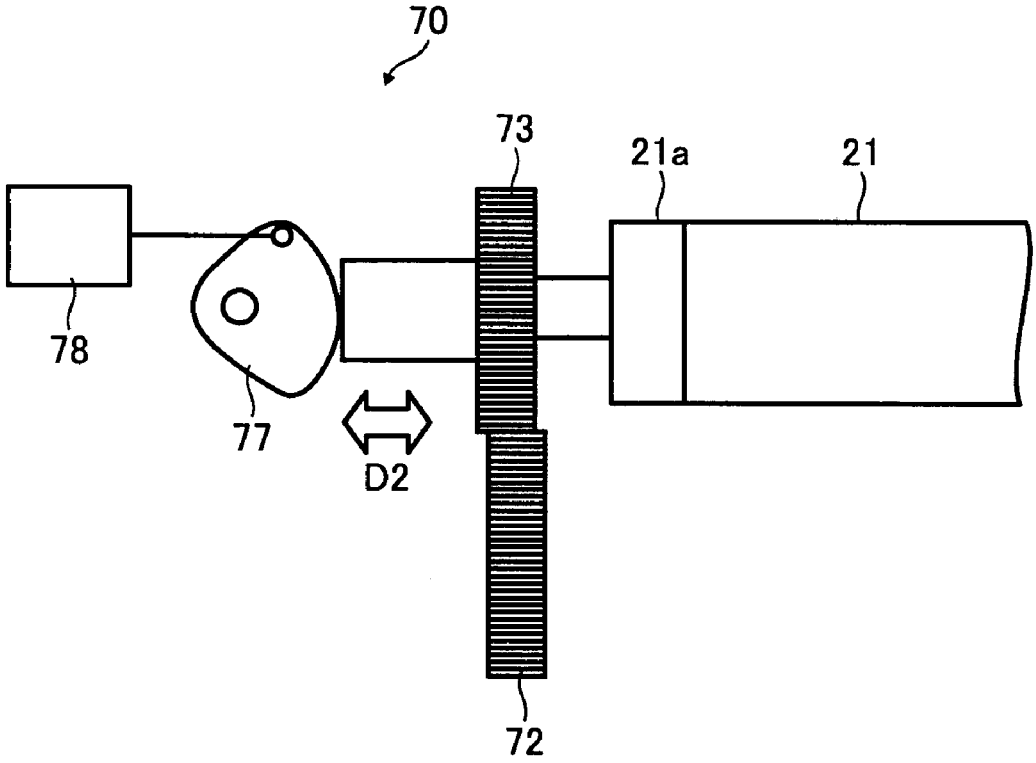
FIG. 7 illustrates a schematic view of a drive mechanism according to another example embodiment.

A description is now given to another configuration of the drive system 70 according to another example embodiment with reference to FIG. 7.

As illustrated in FIG. 7, the driven gear 73 can be moved in a thrust direction D2 when to mesh/unmesh the photoconductive drum 21 with the drive system 70, which is different from a configuration shown in FIG. 4, in which the idler gear 72 is moved in a thrust direction to mesh/unmesh the photoconductive drum 21 with the drive system 70.

As illustrated in FIG. 7, the shift unit having the cam 77 and the solenoid 78 can move the driven gear 73, attached on a shaft of a flange 21*a* of the photoconductive drum 21. Such driven gear 73, rotatable with the photoconductive drum 21, is used as drive force transmission gear.

Specifically, the driven gear 73 has an end face, which contacts the cam 77 coupled to the solenoid 78. Furthermore, although not illustrated, the driven gear 73 and the photoconductive drum 21 are biased toward the cam 77 with a biasing member.

Accordingly, when the solenoid 78 is set to a power-on or power-off condition, the driven gear 73 and the photoconductive drum 21 can be moved in a direction shown by an arrow D2, wherein such direction may be termed as thrust direction or rotation shaft direction.

For example, when the solenoid 78 is set to a power-off condition, the driven gear 73 meshes with the idler gear 72, by which the drive motor 71 can rotate the photoconductive drum 21, and when the solenoid 78 is set to a power-on condition, the driven gear 73 is unmeshed from the idler gear 72, by which the drive motor 71 cannot rotate the photoconductive drum 21.

Furthermore, the photosensor 41 used as phase difference detector detects a phase difference in drive speeds among four photoconductive drums 21, and based on a detection result of the photosensor 41, the shift unit having the cam 77 and the solenoid 78 is controlled to correct a phase difference in drive speeds among the photoconductive drums 21.

As above described, in another example embodiment, a single drive unit (i.e., drive motor 71) transmits a driving force to a plurality of photoconductive drums 21 (used as image carriers) via the driven gear 73 (used as drive force transmission gear) provided for each one of the photoconductive drums 21, and a phase difference in drive speeds among the plurality of photoconductive drums 21 is controlled by moving the driven gear 73 with the shift unit.

Such configuration can achieve reductions in cost and apparatus size of an image forming apparatus while correcting a phase difference in drive speeds among the plurality of photoconductive drums 21 to suppress a displacement of color images of toner images having different color images.

A description is now given to another shift unit according to another example embodiment with reference to FIGS. 8 to 11.

FIG. 8 illustrates a schematic view of a push-up member 80 disposed in the image forming apparatus 1, and FIG. 9 shows a schematic view for illustrating a movement of the push-up member 80. In a configuration shown in FIGS. 8 to 11, the driven gear 73 (used as drive force transmission gear) is meshed/unmeshed with the drive system 70 by moving the photoconductive drum 21 in a given direction with the push-up member 80, which is different from the configurations illustrated in FIGS. 4 and 7.

As illustrated in FIG. 8, a shaft of the photoconductive drum 21 is attached with the driven gear 73, and such shaft is placed on the push-up member 80, which has a protruded portion 80*a* and a rack 80*b*. The rack 80*b* of the push-up member 80 meshes with a pinion 81 provided in the image forming apparatus 1.

Figure 8A:
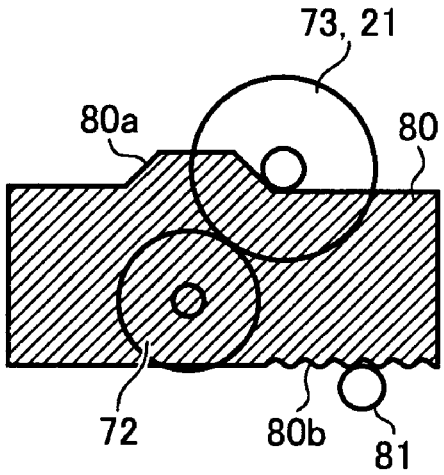
FIGS. 8A and 8B illustrate schematic views of a push-up member of a drive mechanism according to another example embodiment.
Figure 8B:
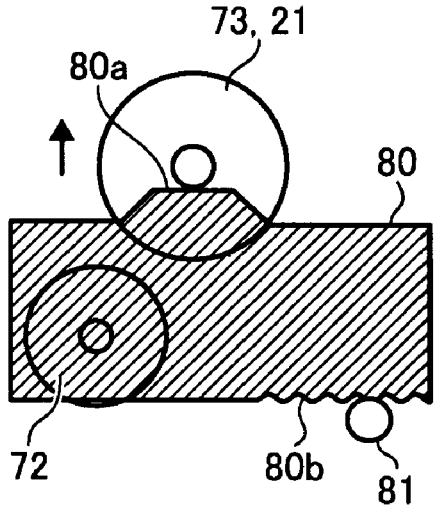

Accordingly, when the pinion 81 rotates in a given direction, the push-up member 80 can be moved in a leftward or rightward in FIG. 8. When the protruded portion 80*a* of the push-up member 80 comes to a position facing the shaft of the photoconductive drum 21 with a movement of the push-up member 80, the photoconductive drum 21 runs on the protruded portion 80*a* as illustrated in FIG. 8B, by which the driven gear 73 is unmeshed from the idler gear 72.

When the driven gear 73 meshes with the idler gear 72 as illustrated in FIG. 8A, the drive motor 71 can rotate the photoconductive drum 21. On one hand, when the driven gear 73 is unmeshed from the idler gear 72 as illustrated in FIG. 8B, the drive motor 71 cannot rotate the photoconductive drum 21. Accordingly, the push-up member 80 and the pinion 81 is used as shift unit.

The push-up member 80 and the pinion 81 may be disposed for each one of the photoconductive drums 21Y, 21M, 21C, and 21K having the driven gears 73Y, 73M, 73C, and 73K, by which a meshing/unmeshing of the driven gears 73Y, 73M, 73C, and 73K can be conducted independently.

Furthermore, the photosensor 41 used as phase difference detector detects a phase difference in drive speeds among four photoconductive drums 21, and based on a detection result of the photosensor 41, the push-up member 80 and the pinion 81 is controlled to correct a phase difference in drive speeds among the photoconductive drums 21.

Figure 9A:
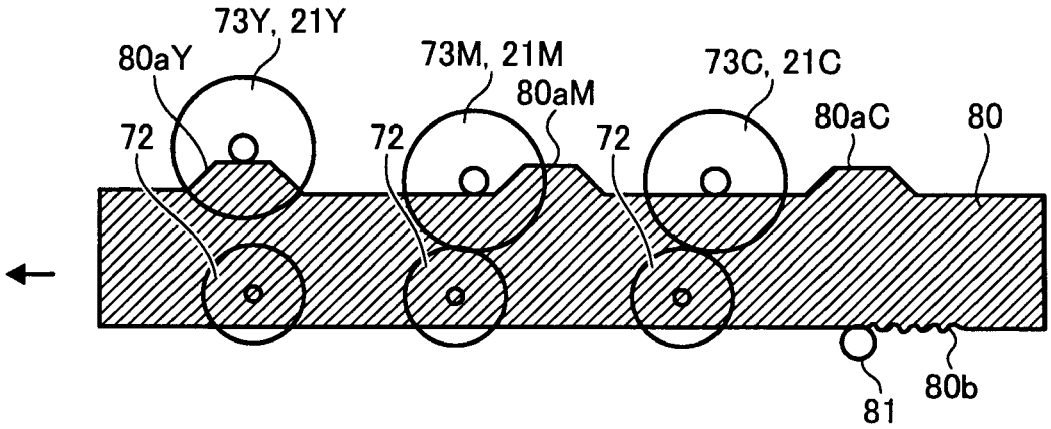
FIGS. 9A to 9C are schematic views for illustrating a movement of the push-up member of FIG. 8.
Figure 9B:
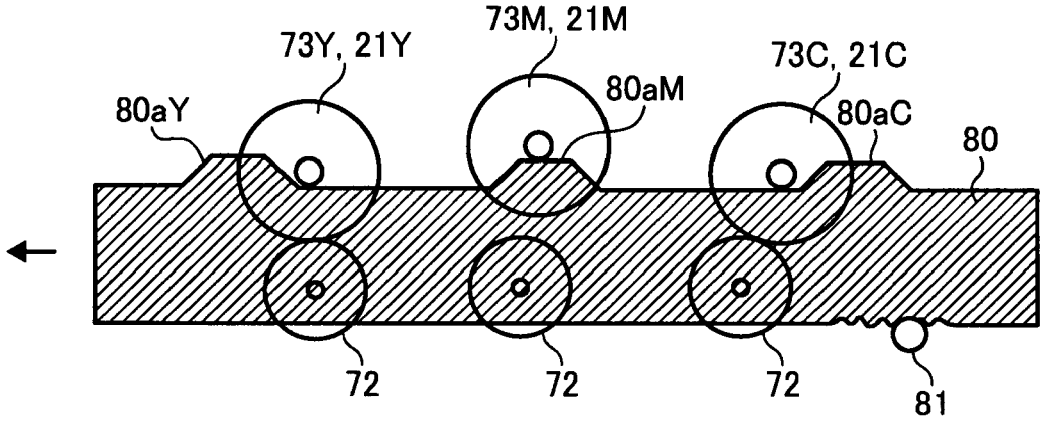
Figure 9C:
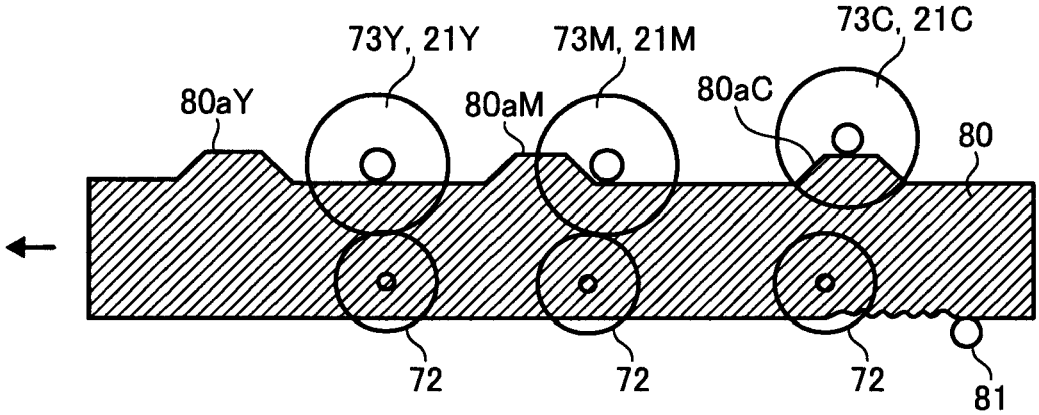

As illustrated in FIGS. 9A to 9C, one push-up member 80 may be used to move the plurality of photoconductive drums 21Y, 21M, 21C (and the driven gears 73Y, 73M, and 73C) independently, for example.

Specifically, the push-up member 80 may have three protruded portions 80*a*Y, 80*a*M, and 80*a*C, which can respectively push a shaft of the photoconductive drums 21Y, 21M, and 21C, independently. With such configuration, a meshing/unmeshing of three driven gears 73Y, 73M, and 73C can be conducted as follows.

When the photoconductive drum 21Y is only pushed up by the protruded portions 80*a*Y as illustrated in FIG. 9A, the driven gear 73Y for yellow is unmeshed from the idler gear 72.

When the photoconductive drum 21M is only pushed up by the protruded portions 80*a*M as illustrated in FIG. 9B, the driven gear 73M for magenta is unmeshed from the idler gear 72.

When the photoconductive drum 21C is only pushed up by the protruded portions 80*a*C as illustrated in FIG. 9C, the driven gear 73C for cyan is unmeshed from the idler gear 72.

Such configuration can preferably reduce a number of parts because one push-up member (i.e., push-up member 80) is commonly used for a plurality of photoconductive drums 21 instead of providing a push-up member for each one of the photoconductive drums 21.

Although the four photoconductive drums 21 are driven by a single drive unit (i.e., drive motor 71) in the above-described example embodiments, the four photoconductive drums 21 can be driven two drive units (or motors), for example. Even if two drive units (or motors) are used for rotating the four photoconductive drums 21, reductions in cost and apparatus size of an image forming apparatus can be achieved compared to a configuration providing a drive unit (or motor) for each of the four photoconductive drums 21.

Figure 10:
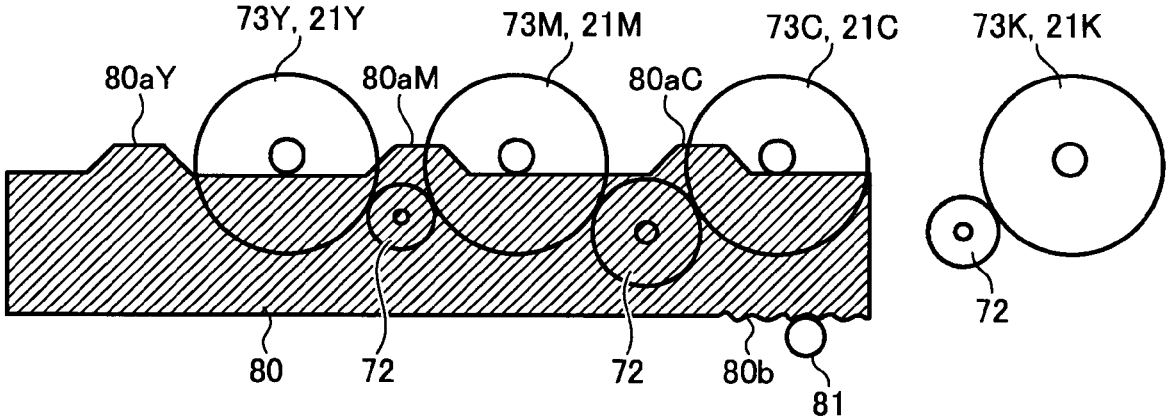
FIG. 10 illustrates a schematic view of another push-up member.

For example, FIG. 10 illustrates an example configuration using two drive motors, in which one drive motor rotates the photoconductive drum 21K for black, and other one drive motor rotates the photoconductive drums 21Y, 21M, and 21C for yellow, magenta, and cyan. In such a configuration, the push-up member 80 may be provided only for the photoconductive drums 21Y, 21M, and 21C to conduct the above-described meshing/unmeshing control.

Accordingly, a drive mechanism for simultaneously driving a plurality of photoconductive drums 21Y, 21M, and 21C is provided in an image forming apparatus of FIG. 10, and a correction of phase difference in drive speeds among a plurality of photoconductive drums 21Y, 21M, and 21C is conducted with the push-up member 80 based on a detection result of the phase difference detector. When to correct a phase difference in drive speed of the photoconductive drum 21K for black, a drive motor for black is set to power on/power off condition.

Figure 11:
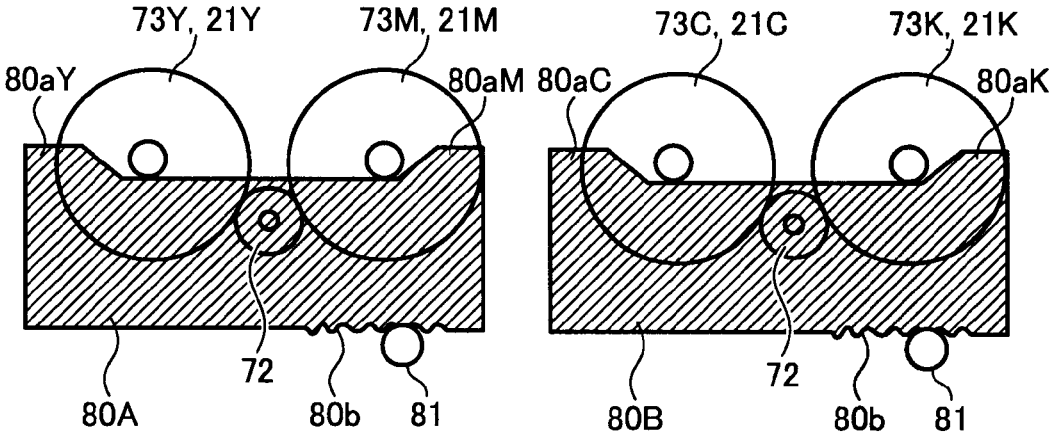
FIG. 11 illustrates a schematic view of another push-up member.

Furthermore, FIG. 11 illustrates another example configuration using two drive motors, in which one drive motor rotates the photoconductive drums 21K and 21C, and other one drive motor rotates the photoconductive drums 21Y and 21M. In such a configuration, a push-up member 80A may be provided for the photoconductive drums 21K and 21C and a push-up member 80B may be provided for the photoconductive drums 21Y and 21M, respectively, to conduct the above-described meshing/unmeshing control.

Accordingly, a drive mechanism for simultaneously driving photoconductive drums 21Y and 21M is provided and other drive mechanism for simultaneously driving photoconductive drums 21C and 21K is provided in an image forming apparatus of FIG. 11.

A correction of phase differences in drive speeds among the photoconductive drums 21Y and 21M is conducted with the push-up member 80A, and a correction of phase difference in drive speeds among the photoconductive drums 21C and 21K is conducted with the push-up member 80B based on a detection result of the phase difference detector.

As above described, in an example embodiment shown in FIG. 9, one drive unit (i.e., drive motor 71) transmits a driving force to a plurality of photoconductive drums 21 (used as image carriers) via the driven gear 73 (used as drive force transmission gear) provided for each one of the photoconductive drums 21, and a phase difference in drive speeds among the plurality of photoconductive drums 21 is controlled by moving the driven gear 73 with the push-up member 80.

Such configuration can achieve reductions in cost and apparatus size of an image forming apparatus while correcting a phase difference in drive speeds among the plurality of photoconductive drums 21 to suppress a displacement of color images of toner images having different color images.

Figure 12:
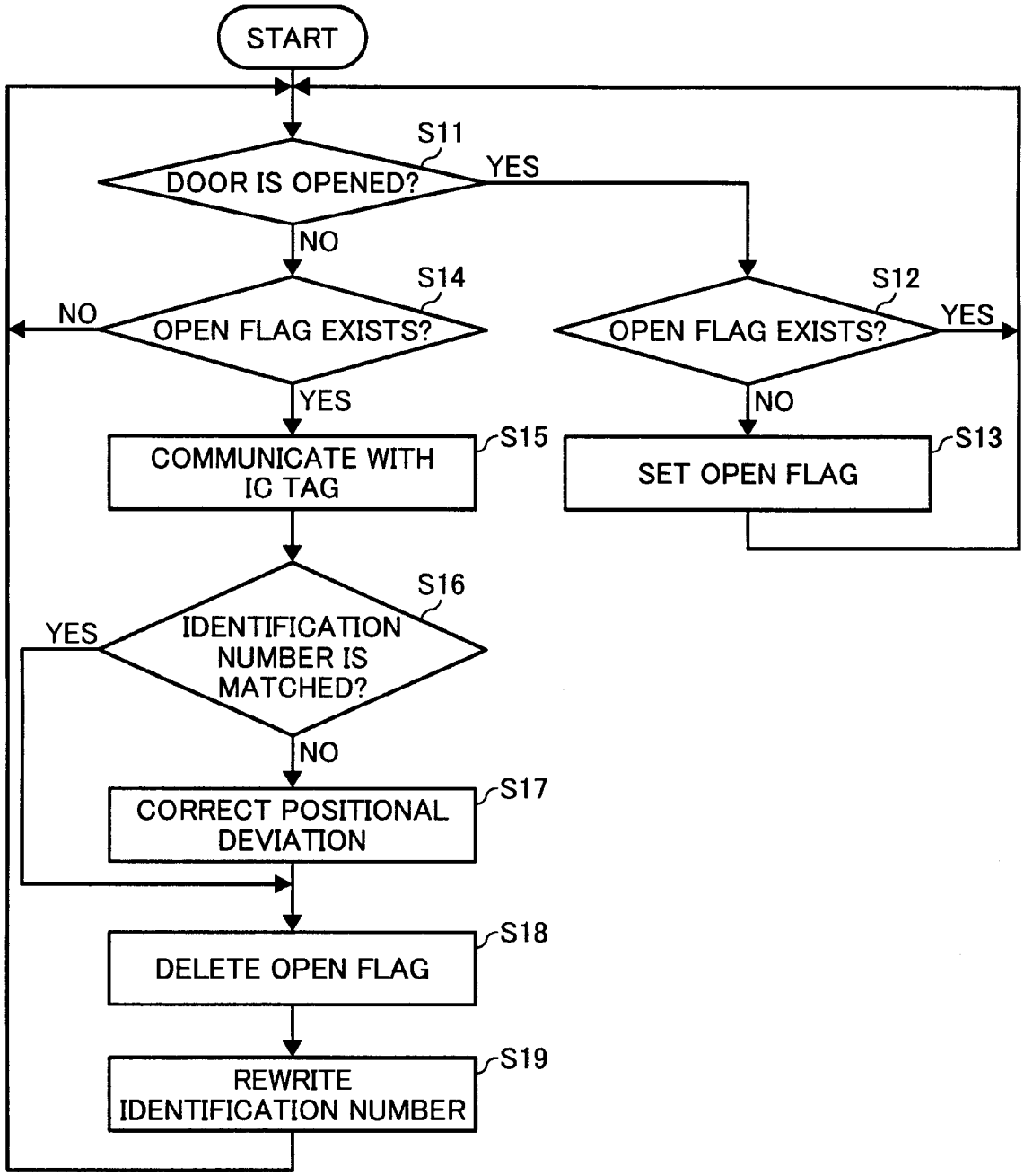
FIG. 12 is a flowchart for illustrating another control process for a positional deviation correction to be conducted in the image forming apparatus of FIG. 1.

A description is now given to another example embodiment with reference to FIG. 12.

FIG. 12 is another flowchart for illustrating a positional deviation correction of the image forming apparatus 1, in which a replacement of the photoconductive drum 21 is determined with a method, which is different from a process illustrated in FIG. 6.

In another example embodiment in FIG. 12, when at least one of the four photoconductive drums 21 is replaced from the image forming apparatus 1, a correction of phase difference in drive speeds among the photoconductive drums 21 is conducted with the shift unit having the cam 77 and the solenoid 78.

Although not illustrated, the photoconductive drum 21 is provided with an IC (integrated circuit) tag storing an identification number of the photoconductive drum 21, and the image forming apparatus 1 provided with a communication device for reading information stored in the IC tag of the photoconductive drum 21.

Based on information of stored in the IC tag of the photoconductive drum 21, a replacement of the photoconductive drum 21 in the image forming apparatus 1 is determined.

As illustrated in FIG. 12, in step S11, it is determined whether a door cover of the image forming apparatus 1 is opened with a signal of a cover sensor (not illustrated) for the door cover.

If it is determined that the door cover is opened (Yes in step S11), it is determined whether an open flag exists in step S12.

If it is determined that the open flag exists (Yes in step S12), it is determined that the door cover is not closed yet, and the process goes back to step S11.

If it is determined that the open flag does not exist (No in step S12), the open flag is set in step S13, and the process goes back to step S11.

If it is determined that the door cover is not opened (or it is determined that the door cover is closed) (No in step S11), it is determined whether an open flag exists in step S14.

If it is determined that the open flag does not exist (No in step S14), it is determined that the photoconductive drum 21 (or process cartridge 20) is not detached/replaced from the image forming apparatus 1, and the process goes back to step S11.

If it is determined that the open flag exists (Yes in step S14), a data communication is conducted between the IC tag of the photoconductive drum 21 and the communication device in step S15.

In step S16, it is determined whether an identification number read out from the IC tag matches with an identification number stored in a memory of the control unit 100.

If it is determined that such two identification number are not matched (No in step S16), it is determined that the photoconductive drum 21 (or process cartridge 20) is detached/replaced from the image forming apparatus 1, and a positional deviation correction is conducted in step S17.

Specifically, based on a detection result detected with the photosensor 41 used as phase difference detector, the shift unit (having the solenoid 78) is activated to correct a phase difference in drive speeds among the photoconductive drums 21.

After correcting phase differences in drive speeds among the photoconductive drums 21, the open flag is deleted in step S18, and an identification number of the replaced photoconductive drum 21 is written to the memory of the image forming apparatus 1 in step S19, and the process completes.

On one hand, if it is determined that such two identification number are matched (Yes in step S16), it is determined that the photoconductive drum 21 (or process cartridge 20) is not detached/replaced from the image forming apparatus 1, and a positional deviation correction is not conducted, and the process completes after conducting steps S18 and S19.

As above described, whenever the photoconductive drum 21 (or process cartridge 20) is detached or replaced from the image forming apparatus 1, a positional deviation correction is conducted for the photoconductive drums 21, by which a plurality of toner images may be superimposingly transferred onto the intermediate transfer belt 27 while suppressing displacement of color images.

Such configuration can achieve reductions in cost and apparatus size of an image forming apparatus while correcting a phase difference in drive speeds among the plurality of photoconductive drums 21 to suppress a displacement of color images of toner images having different color images.

Figure 13:
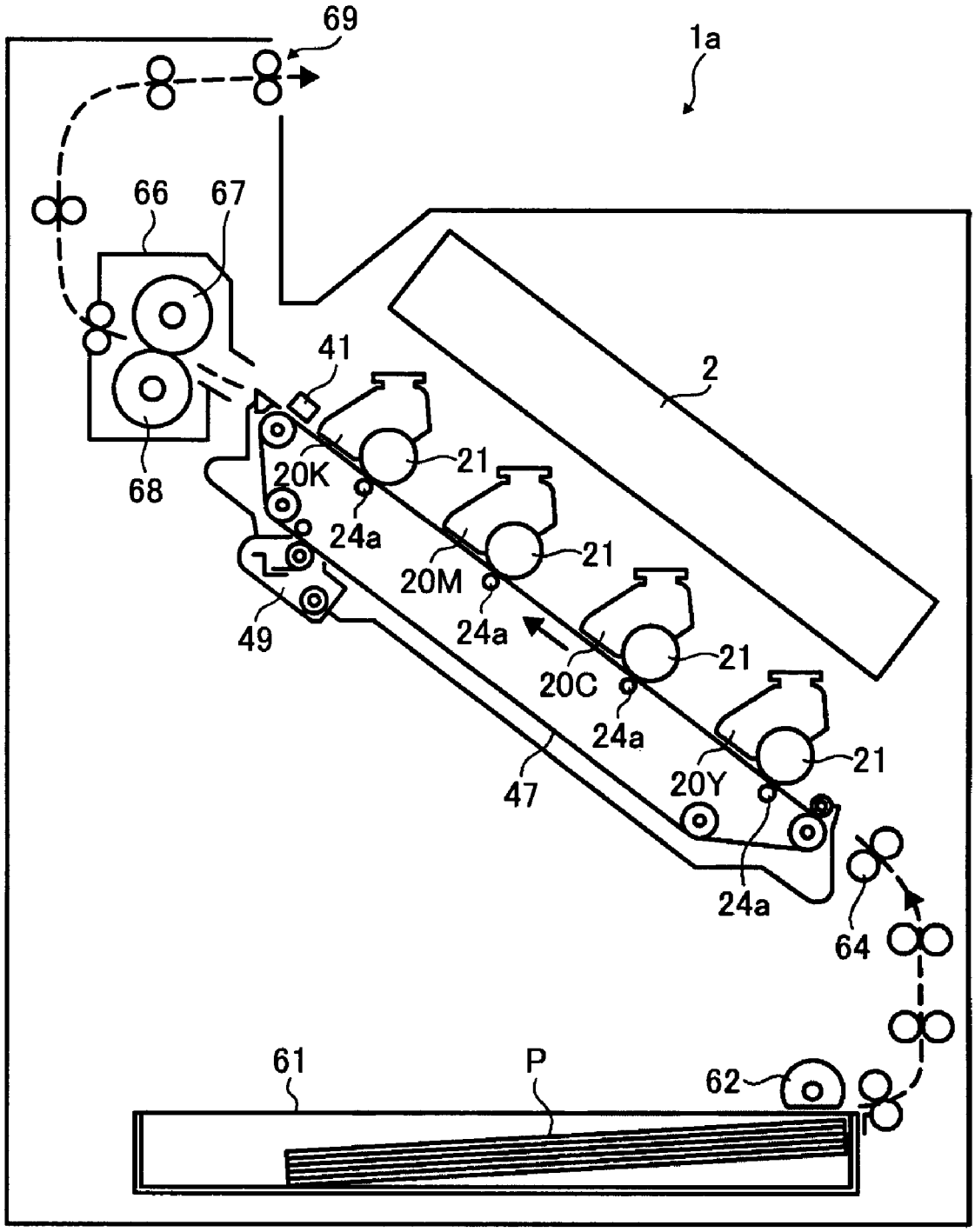
FIG. 13 illustrates a schematic configuration of another image forming apparatus according to another example embodiment.

A description is now given to another image forming apparatus according to another example embodiment with reference to FIG. 13.

FIG. 13 illustrates a schematic configuration of an image forming apparatus 1*a*. Instead of the intermediate transfer belt 27 provided in the image forming apparatus 1 illustrated in FIG. 1, the image forming apparatus 1*a* has a transfer/transport belt 47 as transfer member.

As illustrated in FIG. 13, the image forming apparatus 1*a* includes four process cartridges 20Y, 20M, 20C, and 20K facing the transfer/transport belt 47. Each of the process cartridges 20Y, 20M, 20C, and 20K has the photoconductive drum 21 as image carrier, a charger, a developing unit, a cleaning unit, for example, to form toner images of yellow, magenta, cyan, and black on respective photoconductive drum 21. Such toner images formed on the photoconductive drums 21 are transferred to a recording medium P transported by the transfer/transport belt 47.

The transfer/transport belt 47, made of a resin material such as PI (polyimide), PVDF (polyvinylidine difluoride), ETFE (ethylenetetrafluoroethylene), and PC (polycarbonate), is extended by a plurality of rollers and travels in a counter clockwise direction in FIG. 13.

As illustrated in FIG. 13, the photosensor 41, used as phase difference detector, faces the transfer/transport belt 47 at a downstream of process cartridges 20Y, 20M, 20C, and 20K to detect an image formed on the transfer/transport belt 47.

An image forming process by the image forming apparatus 1*a* is described as follows.

In each of the process cartridges 20Y, 20M, 20C, and 20K, the photoconductive drum 21 rotates in a clockwise direction, for example. Such photoconductive drum 21 is charged to a given potential by the charger, which is placed over a surface of the photoconductive drum 21 with a given gap.

Such charged surface of the photoconductive drum 21 is then scanned by a light beam coming from the optical writing unit 2 to form a latent image on the photoconductive drum 21, wherein the optical writing unit 2 irradiates a light beam (e.g., laser beam) corresponding to image information for each color to the photoconductive drum 21.

After forming the latent image on the photoconductive drum 21, the photoconductive drum 21 comes to a position facing the developing unit, wherein the developing unit stores toner for yellow, magenta, cyan, or black.

Such developing unit supplies toner for yellow, magenta, cyan, or black to the latent image on the photoconductive drum 21 to develop a toner image for yellow, magenta, cyan, or black on the photoconductive drum 21. After forming the toner image, the photoconductive drum 21 comes to a position facing the transfer/transport belt 47.

When such image forming is conducted, the sheet feed unit 61 feeds the recording medium P to a transport route to transport the recording medium P to the transfer/transport belt 47. Such recording medium P is adhered on the transfer/transport belt 47 by an effect of adsorption roller, and moves with the transfer/transport belt 47 traveling in one direction.

During such traveling of the recording medium P, toner images of yellow, cyan, magenta, and black on each of the photoconductive drum 21 are transferred onto the recording medium P.

Such toner-image transferring to the recording medium P is conducted by a transfer roller 24*a*, sandwiching the transfer/transport belt 47 with the photoconductive drum 21. Specifically, each of the transfer roller 24*a* is applied with a transfer voltage having an opposite polarity of toner adhered on the photoconductive drum 21.

After transferring toner images on the recording medium P, the recording medium P is separated from the transfer/transport belt 47, and transported to the fixing unit 66. The fixing unit 66 applies heat and pressure to the recording medium P to fix the toner images on the recording medium P. After the fixing process, the recording medium P is ejected from the image forming apparatus 1*a*. After separating the recording medium P, the surface of the transfer/transport belt 47 is cleaned by the belt cleaning unit 49. Then, an image forming process by the image forming apparatus 1*a* completes.

As similar to the above-example embodiments, the shift unit having the cam 77 and the solenoid 78 can be provided for each one of the photoconductive drums 21Y, 21M, 21C, and 21K (or the idler gears 72Y, 72M, 72C, and 72K), by which each of the idler gears 72Y, 72M, 72C, and 72K can be independently set to a meshed or unmeshed condition.

The above-mentioned photosensor 41 is used as phase difference detector to detect a phase difference in drive speeds among four photoconductive drums 21. Based on a detection result of the photosensor 41, the shift unit having the cam 77 and the solenoid 78 is controlled to correct a phase difference in drive speeds among the photoconductive drums 21. Specifically, the photosensor 41 detects an image patch pattern for each color transferred onto the intermediate transfer belt 27 from each of photoconductive drums 21.

In another example embodiment illustrated in FIG. 13, an image patch pattern is formed on the transfer/transport belt 47, not on the recording medium P, when detecting a phase difference in drive speeds among a plurality of photoconductive drums 21. Specifically, an image patch pattern of each color formed on each of the photoconductive drums 21 is transferred on the transfer/transport belt 47, and the photosensor 41 detects each image patch pattern to detect a phase difference in drive speeds among the photoconductive drums 21.

Such configuration can achieve reductions in cost and apparatus size of an image forming apparatus while correcting a phase difference in drive speeds among the plurality of photoconductive drums 21 to suppress a displacement of color images of toner images having different color images.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus, comprising:

a plurality of image carriers configured to form a plurality of color images;

a drive mechanism configured to drive the plurality of image carriers simultaneously, the drive mechanism including a single drive unit for driving the plurality of image carriers;

a plurality of drive force transmission gears provided for each of the plurality of image carriers, respectively, the gears configured to transmit a driving force from the single drive unit to the plurality of image carriers;

a phase difference detector configured to detect a phase difference in drive speed among the plurality of image carriers; and a plurality of shift units provided for each of the plurality of drive force transmission gears, respectively, and each of the shift units configured to mesh or unmesh a respective one of the drive force transmission gears to the drive mechanism, each of the shift units being activated to correct the phase difference in drive speed among the plurality of image carriers based on a detection result obtained by the phase difference detector, wherein each of the shift units meshes with the drive mechanism independently of the other shift units such that each of the shift units corrects the phase difference independently of each of the other shift units.

2. The image forming apparatus according to claim 1, further comprising:

an intermediate transfer member disposed opposite the plurality of image carriers and configured to transfer an image patch pattern of each color from the plurality of image carriers, wherein the phase difference detector is an optical sensor disposed opposite the intermediate transfer member and configured to detect the image patch pattern of each color transferred to the intermediate transfer member to detect any phase difference in drive speed among the plurality of image carriers.

3. The image forming apparatus according to claim 2, wherein the intermediate transfer member is an intermediate transfer belt stretched over a plurality of rollers including a drive roller, the image patch patterns are formed on the intermediate transfer belt at intervals equivalent to a circumference of the drive roller for driving the intermediate transfer belt.

4. The image forming apparatus according to claim 2, wherein the intermediate transfer member is any one of an intermediate transfer belt and an intermediate transfer drum.

5. The image forming apparatus according to claim 2, wherein the optical sensor detects a detection time of each of the image patch patterns to detect any phase difference in drive speed among the plurality of image carriers.

6. The image forming apparatus according to claim 1, further comprising:

a transfer/transport belt disposed opposite the plurality of image carriers, configured to transport a recording medium thereon and the recording medium transported on the transfer/transport belt is transferred with toner images of each color from the plurality of image carriers, wherein the phase difference detector is an optical sensor disposed opposite the transfer/transport belt and configured to detect an image patch pattern of each color transferred to the transfer/transport belt from the plurality of image carriers, and the optical sensor detects the image patch pattern of each color, transferred to the transfer/transport belt from the plurality of image carriers, to detect any phase difference in drive speed among the plurality of image carriers.

7. The image forming apparatus according to claim 1, wherein the drive force transmission gear is an idler gear, and the shift unit moves the idler gear in a thrust direction to mesh and unmesh the idler gear with the drive mechanism.

8. The image forming apparatus according to claim 1, wherein the drive force transmission gear is a driven gear integrally driven with the image carrier, and the shift unit moves the driven gear in a thrust direction to mesh and unmesh the driven gear with the drive mechanism.

9. The image forming apparatus according to claim 1, wherein the drive force transmission gear is a driven gear integrally driven with the image carrier, and the shift unit is a push-up member, which moves the driven gear to mesh and unmesh the driven gear with the drive mechanism.

10. The image forming apparatus according to claim 9, wherein the push-up member is a single push-up member configured to move each one of the plurality of image carriers separately.

11. The image forming apparatus according to claim 1, wherein the shift unit is activated to correct the phase difference in drive speed among the plurality of image carriers based on a detection result of the phase difference detector when at least one of the plurality of image carriers is detached or replaced from the image forming apparatus.

12. The image forming apparatus according to claim 1, wherein the apparatus is configured to detect a rotational position of each one of the plurality of image carriers.

13. The image forming apparatus according to claim 1, wherein each of the drive force transmission gears is provided at a position closer to the single drive unit than the image carrier in the drive mechanism.

14. The image forming apparatus according to claim 1, wherein each one of the plurality of image carriers is integrally included in a process cartridge, the process cartridge being detachably disposed in the image forming apparatus.

15. The image forming apparatus according to claim 1, wherein each of the plurality of shift units is activated to correct the phase difference of at least two image carriers of the plurality of image carriers, and the plurality of image carriers are photoconductor drums for black, yellow, cyan, and magenta.

16. The image forming apparatus according to claim 1, wherein the drive unit is any one of a stepping motor and a direct current motor having a brake function.

17. The image forming apparatus according to claim 2, wherein the phase difference detector transmits a detection signal to a control unit configured to compute a phase difference in drive speeds among the image carriers based on the detection time of the image patch patterns of each color.

18. The image forming apparatus according to claim 1, wherein the single drive unit is coupled to each of the plurality of image carriers by setting a plurality of driving force transmission routes to transmit the driving force from the single drive unit to each of the image carriers, each of the driving force transmission routes is set for each of the image carriers, and each of the driving force transmission routes is provided with one shift unit.

* * * * *